US010495088B2

(12) United States Patent
Oh et al.

(10) Patent No.: US 10,495,088 B2
(45) Date of Patent: Dec. 3, 2019

(54) SCROLL COMPRESSOR

(71) Applicant: LG ELECTRONICS INC., Seoul (KR)

(72) Inventors: Junchul Oh, Seoul (KR); Jaeha Lee, Seoul (KR); Seheon Choi, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 84 days.

(21) Appl. No.: 15/246,650

(22) Filed: Aug. 25, 2016

(65) Prior Publication Data

US 2017/0067466 A1 Mar. 9, 2017

(30) Foreign Application Priority Data

Sep. 7, 2015 (KR) ..... 10-2015-0126497

(51) Int. Cl.
*F01C 17/06* (2006.01)
*F04C 29/00* (2006.01)
(Continued)

(52) U.S. Cl.
CPC ..... *F04C 29/0057* (2013.01); *F01C 17/066* (2013.01); *F04C 18/0215* (2013.01);
(Continued)

(58) Field of Classification Search
CPC ..... F01C 17/066; F04C 29/0057
(Continued)

(56) References Cited

U.S. PATENT DOCUMENTS 4,934,909 A 6/1990 Suzuki et al.
5,842,845 A * 12/1998 Kawano ..... F01C 17/066 29/888.022

(Continued)

FOREIGN PATENT DOCUMENTS

CN 1226639 8/1999
CN 1515798 7/2004

(Continued)

OTHER PUBLICATIONS

English translation of JP2000283063 by Espacenet Oct. 17, 2018.*

(Continued)

*Primary Examiner* — Deming Wan
(74) *Attorney, Agent, or Firm* — KED & Associates LLP

(57) ABSTRACT

A scroll compressor is provided that may include a casing having a sealed inner space; a drive motor provided in the inner space of the casing to generate a rotational force; a rotational shaft rotatably coupled to the drive motor; an orbiting scroll formed of an aluminum material, and coupled to the rotational shaft to perform an orbiting movement; a fixed scroll coupled to the orbiting scroll to form a compression space; and an Oldham ring coupled to the orbiting scroll, and formed of a sintered metal. With this structure, it may be possible to prevent the Oldham ring from being worn out due to contact with the orbiting scroll. Further, a weight loss portion or wear-resistant coating layer may be formed on a portion of the Oldham ring, thereby suppressing or preventing vibration noise of the scroll compressor from being increased due to a weight increase of the Oldham ring.

14 Claims, 10 Drawing Sheets

(51) Int. Cl.
*F04C 18/02* (2006.01)
*F04C 23/00* (2006.01)

(52) U.S. Cl.
CPC ..... *F04C 23/008* (2013.01); *F04C 29/0085* (2013.01); *F04C 2210/26* (2013.01); *F04C 2230/41* (2013.01); *F04C 2230/91* (2013.01); *F04C 2240/10* (2013.01); *F04C 2240/20* (2013.01); *F04C 2240/30* (2013.01); *F04C 2270/16* (2013.01); *F05C 2201/021* (2013.01); *F05C 2201/0454* (2013.01); *F05C 2201/0466* (2013.01); *F05C 2203/04* (2013.01); *F05C 2251/10* (2013.01); *F05C 2253/12* (2013.01)

(58) Field of Classification Search
USPC ..... 418/55.3, 55.1–55.5; 464/102, 104, 105
See application file for complete search history.

(56) References Cited

U.S. PATENT DOCUMENTS 6,106,252 A * 8/2000 Yamanaka ..... F01C 17/06 29/557
6,135,737 A * 10/2000 Miura ..... F01C 17/066 418/1
6,146,117 A * 11/2000 Miura ..... F01C 17/066 418/55.3
7,661,938 B2 * 2/2010 Ginies ..... F01C 17/066 418/179
2009/0047161 A1 2/2009 Ginies et al.
2009/0110581 A1 * 4/2009 Fontaine ..... F04C 18/0215 418/55.3
2009/0148326 A1 * 6/2009 Fujiwara ..... F01C 17/066 418/55.1
2011/0044833 A1 * 2/2011 Dunaevsky ..... F01C 17/066 418/55.3
2011/0142384 A1 * 6/2011 Hofmann ..... C23C 30/005 384/42
2013/0251568 A1 9/2013 Bush
2015/0118090 A1 4/2015 Lachey et al.

FOREIGN PATENT DOCUMENTS

CN 203627233 6/2014
JP 04-318297 11/1992
JP 04-330391 11/1992
JP H05 223068 8/1993
JP 06-88578 3/1994
JP 06-88579 3/1994
JP 07247966 9/1995
JP 2000-283063 10/2000
JP 2000283063 A * 10/2000 ..... F01C 17/066
JP 2000337272 A * 12/2000 ..... F01C 17/066
JP 2007-205423 8/2007
JP 2013-024051 2/2013
KR 10-0224325 10/1999
KR 10-2006-0104460 10/2006
KR 10-0696129 3/2007
KR 10-2011-0123575 11/2011

OTHER PUBLICATIONS

English translation of JP2000337272 by Espacenet Oct. 17, 2018.*
Korean Office Action dated Aug. 23, 2016 issued in Application No. 10-2015-0126497.
Korean Notice of Allowance dated Dec. 26, 2016 issued in Application No. 9-5-2016-093167616.
European Search Report dated Feb. 3, 2017 issued in Application No. 16186211.5.
Chinese Office Action dated Jan. 17, 2018 (English Translation).
Chinese Office Action dated Aug. 30, 2018 with English Translation.

* cited by examiner

SCROLL COMPRESSOR

CROSS-REFERENCE TO RELATED APPLICATION(S)

The present application claims priority to Korean Application No. 10-2015-0126497, filed in Korea on Sep. 7, 2015, which is herein expressly incorporated by reference in its entirety.

BACKGROUND

1. Field

A scroll compressor is disclosed herein.

2. Background

A scroll compressor is a compressor in which a fixed scroll is fixed to or in an inner space of a casing, and a pair of compression spaces including a suction chamber, an intermediate pressure chamber, and a discharge chamber are formed between a fixed wrap of the fixed scroll and an orbiting wrap of an orbiting scroll while the orbiting scroll engaged with the fixed scroll performs an orbiting movement. The scroll compressor is widely used to compress refrigerant in an air conditioning unit, for example, due to an advantage of being capable of obtaining a stable torque as suction, compression, and discharge strokes are smoothly carried out, as well as obtaining a relatively higher compression ratio compared to other types of compressors. In recent years, high-efficiency scroll compressors, in which an eccentric load is reduced to have an operation speed of above 180 Hz have been developed.

FIG. 1 is a longitudinal cross-sectional view illustrating an example of a high-pressure compressor (hereinafter, abbreviated as a "scroll compressor") in the related art. As illustrated in the drawing, according to a scroll compressor in the related art, a drive motor 20 to generate a rotational force is provided in an inner space 11 of a sealed casing 10, and a mainframe 30 is provided at an upper side of the drive motor 20.

A fixed scroll 40 is provided in a fixed manner on an upper surface of the mainframe 30, and an orbiting scroll 50 is provided in an orbital manner between the mainframe 30 and the fixed scroll 40. The orbiting scroll 50 is coupled to a rotational shaft 60 coupled to a rotor 22 of the drive motor 20.

The orbiting scroll 50 is formed with an orbiting wrap 52 engaged with a fixed wrap 43 of the fixed scroll 40 to form a pair of consecutively moving compression spaces (P). The pair of compression space (P) is consecutively formed with a suction chamber, an intermediate pressure chamber, and a discharge chamber, and the intermediate pressure chamber is consecutively formed with several phases.

Further, an Oldham ring 70 that prevents a rotational movement of the orbiting scroll 50 is provided between the fixed scroll 40 and the orbiting scroll 50. The Oldham ring 70 is formed of an aluminum material.

As illustrated in FIG. 2, the Oldham ring 70 includes a ring portion or ring 71 formed in an annular shape, and a plurality of key portions or keys 75 formed in a protruding manner on both axial-directional lateral surfaces of the ring portion 71. The ring portion 71 is formed in a ring shape, and the entire both axial-directional lateral surfaces excluding the key portion 75 are formed in a flat shape. However, according to circumstances, thrust surfaces may be formed in a protruding manner by a predetermined height in a stepwise manner on both axial-directional lateral surfaces, respectively, around the key portion 75.

The key portion 75 may include a first key portion or key 76 slidably inserted into a key groove 35 of the mainframe 30 and a second key portion or key 78 slidably inserted into a key groove 55 of the orbiting scroll 50.

The first key portion 76 is formed on one axial-directional lateral surface of the ring portion 71 space at intervals of 180 degrees along a circumferential direction, and the second key portion 78 is formed on the other axial-direction lateral surface of the ring portion 71 spaced at intervals of 180 degrees along the circumferential direction. The first key portion 76 and second key portion 78 are alternately formed at intervals of 90 degrees along the circumferential direction when projected onto a plane.

An oil separator 90 that communicates with a discharge pipe 16 to separate oil from refrigerant discharged from the casing 10 is provided at one side of the casing 10, an oil return pipe 91 that communicates with the inner space 11 of the casing 10 filled with oil to return the separated oil to the casing 10 is connected to a lower end of the oil separator 90, and a refrigerant pipe 92 configured to guide refrigerant from which oil has been separated to a condenser of a cooling cycle is connected to at an upper end of the oil separator 90.

On the drawing, reference numerals 15, 21, 41, 42, 44, 45, 51, 53, 61, 62, 65, and 80 are a suction pipe, a stator, an end plate portion or end plate of the fixed scroll 40, a side wall portion or side wall of the fixed scroll 40, a suction port, a discharge port, an end plate portion or end plate of the orbiting scroll 50, a boss portion or boss, an oil passage, a boss portion insertion groove, a balance weight, and a sub-frame, respectively.

According to the foregoing scroll compressor in the related art, when power is applied to the drive motor 20 to generate a rotational force, the rotational shaft 60 transfers the rotational force of the drive motor 20 to the orbiting scroll 50. Then, the orbiting scroll 50 forms the pair of compression spaces (P) between the orbiting scroll 50 and the fixed scroll 40 while performing an orbiting movement with respect to the fixed scroll 40 by the Oldham ring 70 to suck, compress, and discharge refrigerant.

Though the orbiting scroll 50 receives a rotational force in a circumferential direction by the rotational shaft 60, wear due to a concentrated load may be generated between one lateral surface of the first key portion 76 and the second key portion 78 and one lateral surface of each key groove 35, 55, as the first key portion 76 and the second key portion 78 of the Oldham ring 70 are slidably inserted in a radial direction into the key groove 35 of the mainframe 30 and the key groove 55 of the orbiting scroll 50. However, the first key portion 76 of the Oldham ring 70 and the key groove 35 of the orbiting scroll 50 may be formed in a direction perpendicular to the second key portion 78 of the Oldham ring 70 and the key groove 55 of the orbiting scroll 50, thereby suppressing wear between each key and key groove, as well as allowing the orbiting scroll 50 to perform the orbiting movement with respect to the mainframe 30. On the drawing, reference numerals t1 and t2 are a thickness of the ring portion and a thickness between both thrust surfaces.

However, the foregoing scroll compressor in the related art has a problem of generating severe wear on the Oldham ring 70 as both the orbiting scroll 50 and Oldham ring 70 are formed of an aluminum material. Typically, in a case in which two members being slidably brought into contact with each other are formed of the same type material, it causes relatively high wear compared to a case of being formed of different types of materials. In consideration of this, when the Oldham ring 70 is formed of a material with a high hardness, such as cast iron, for example, a weight of the Oldham ring 70 is increased to increase an eccentric load due to a centrifugal force, thereby causing a problem of increasing vibration noise of the compressor.

BRIEF DESCRIPTION OF THE DRAWINGS

Embodiments will be described in detail with reference to the following drawings in which like reference numerals refer to like elements, and wherein.

DETAILED DESCRIPTION

Figure 1:
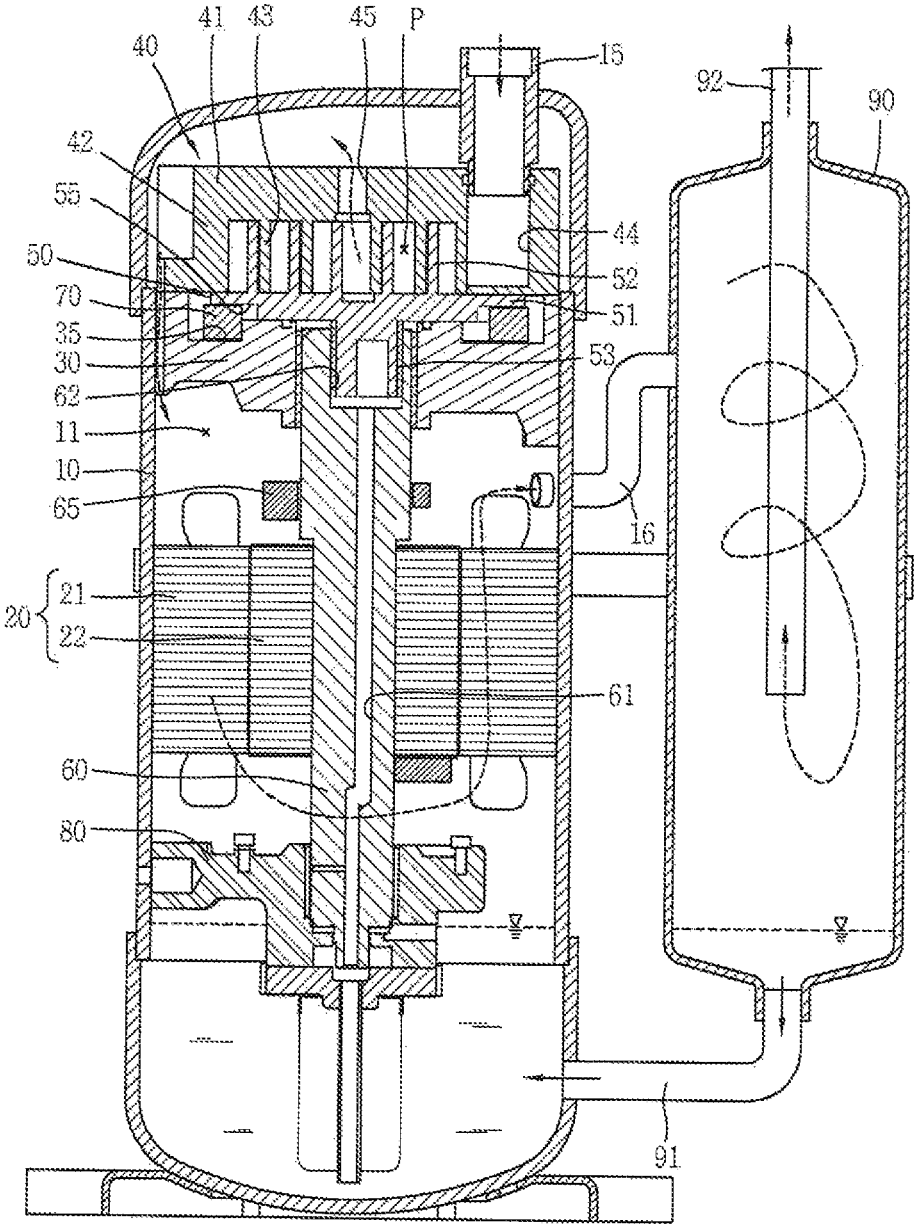
FIG. 1 RELATED ART
FIG. 1 is a cross-sectional view illustrating an example of a scroll compressor in the related art.

Hereinafter, a scroll compressor according to embodiments will be described with reference to the accompanying drawings. Where possible, like reference numerals have been used to indicate like elements, and repetitive disclosure has been omitted.

Figure 3:
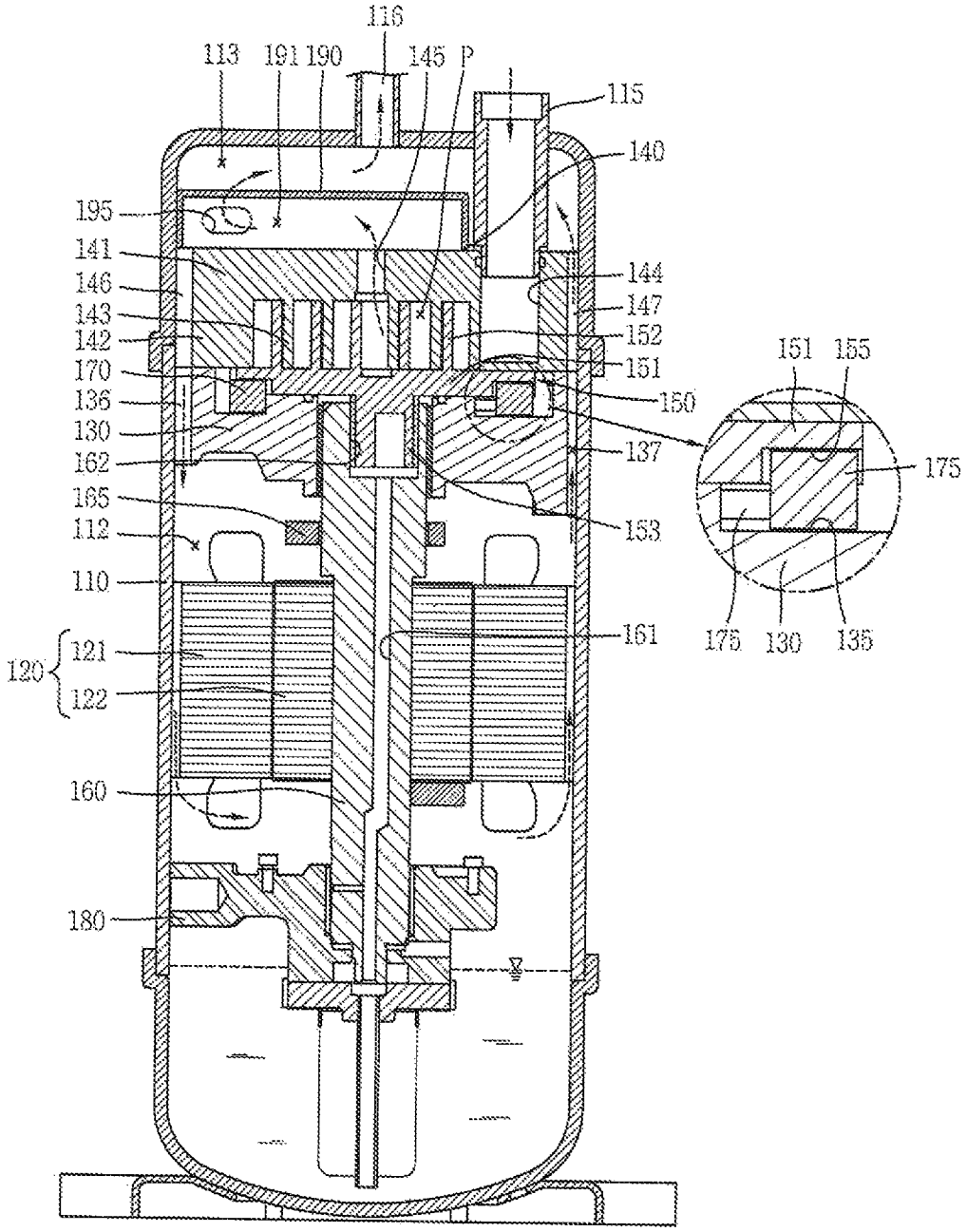
FIG. 3 is a longitudinal cross-sectional view illustrating a scroll compressor according to an embodiment.
Figure 4:
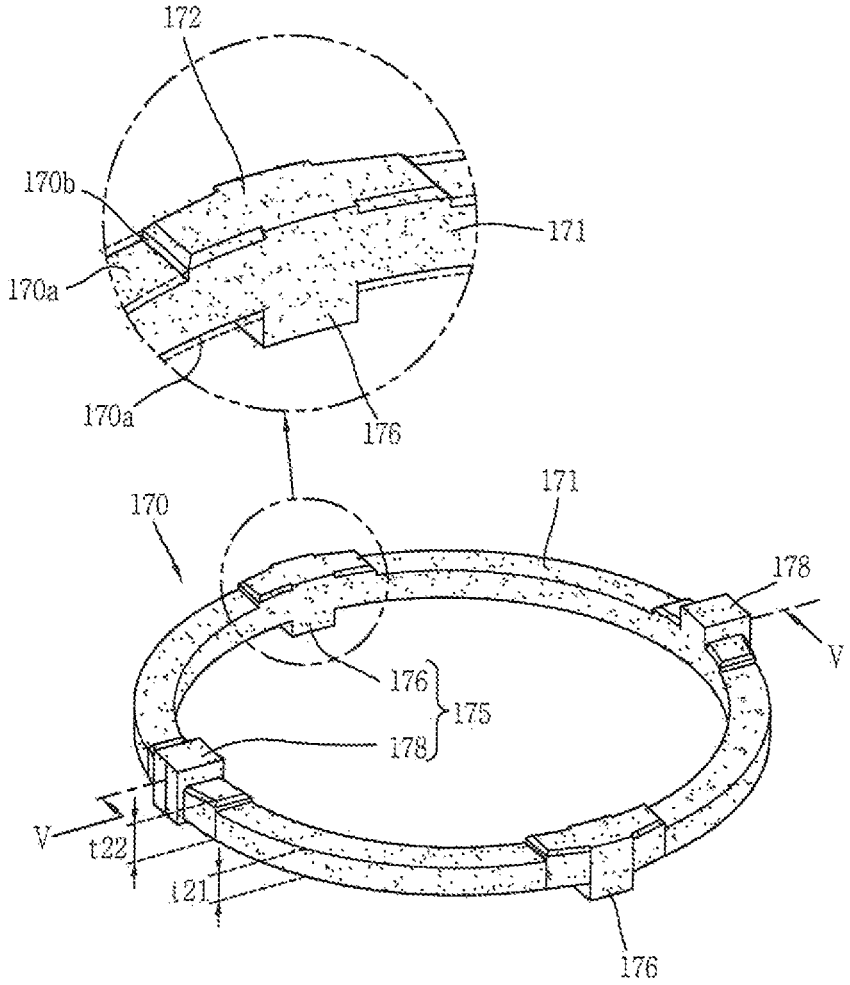
FIG. 4 is a perspective view illustrating an Oldham ring illustrated in FIG. 3.
Figure 5:
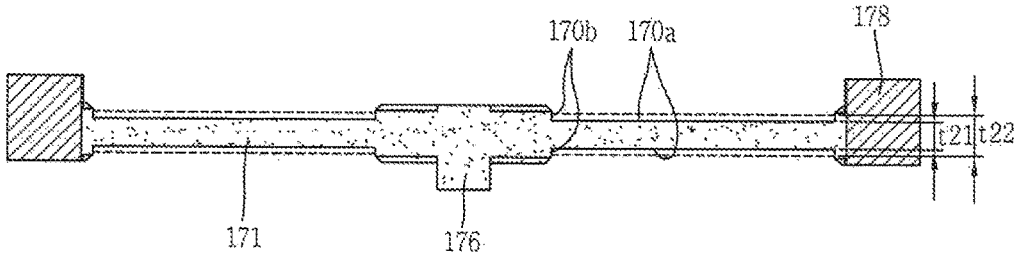
FIG. 5 is a cross-sectional view taken along line "V-V" in FIG. 4.

FIG. 3 is a longitudinal cross-sectional view illustrating a scroll compressor according an embodiment. FIG. 4 is a perspective view illustrating an Oldham ring illustrated in FIG. 3. FIG. 5 is a cross-sectional view taken along line "V-V" in FIG. 4.

As illustrated in FIG. 3, in a scroll compressor according to an embodiment, an inner space of a casing 110 may be sealed, and the inner space may be divided into a motor space 112 provided with a drive motor 120, which will be described hereinafter, and an oil separation space 113, in which refrigerant discharged from a compression space may be temporarily filled. However, the motor space 112 and oil separation space 113 may communicate with each other by communication holes 146, 147 and communication grooves 136, 137, respectively. As a result, a portion of refrigerant discharged from a compression space (P) to the oil separation space 113 may be discharged through a discharge pipe 116, whereas another portion of refrigerant may be moved from the compression chamber (P) to the motor space 112 and moved again to the oil separation space 113, and then discharged through the discharge pipe 116.

The drive motor 120 that generates a rotational force may be installed or provided in the motor space 112 of the casing 110, and a rotational shaft 160 having an oil passage 161 may be coupled to a rotor 122 of the drive motor 120. The rotational shaft 160 may be coupled to an orbiting scroll 150, which will be described hereinafter, to transmit a rotational force of the drive motor 120 to the orbiting scroll 150. In the drawing, reference numeral 121 is a stator.

A main frame 130 that divides the motor space 112 and the oil separation space 113 and supports an end of the rotational shaft 160 may be fixed and provided at an upper side of the drive motor 120, and a fixed scroll 140 that divides the motor space 112 and the oil separation space 113 along with the main frame 130 may be fixed and provided on an upper surface of the main frame 130. Accordingly, the main frame 130 and the fixed scroll 140 may be fixed and coupled together to the casing 110. However, the fixed scroll 140 may be coupled thereto so as not to move in a circumferential direction while sliding in a vertical direction with respect to the main frame 130.

The main frame 130 may be formed of a material with a high hardness, such as cast iron, for example, and the fixed scroll 140 may be formed of a lighter material than the iron cast, such as an aluminum material. Accordingly, it may be possible to enhance formability, as well as reduce a weight of the scroll compressor.

The fixed scroll 140 may be formed with an end plate portion or end plate 141 in a disk shape, and an annular side wall portion or side wall 142 separated by a predetermined height from an upper surface of the main frame 130 and fixed and coupled thereto may be formed at a lower surface edge of the end plate portion 141, and a fixed wrap 143 that forms the compression space (P) along with the orbiting scroll 150 may be formed at an inside of the side wall portion 142. A thrust surface that forms a thrust bearing surface along with an end plate portion or end plate 151 of the orbiting scroll 150 may be formed on a bottom surface of the side wall portion 142.

A suction port may be formed at one side of the end plate portion 141 of the fixed scroll 140 to communicate with a suction chamber, which will be described hereinafter, and a discharge port that communicates with a discharge chamber, which will be described hereinafter, may be formed at a center of the end plate portion 141. A first communication hole 146 may be formed at one or a first side of an outer circumferential surface of the end plate portion 141 of the fixed scroll 140 to move refrigerant discharged through the discharge port or oil separated from the refrigerant to the motor space 112 of the casing 110 provided with the drive motor 120, and a second communication hole 147 may be formed at another or a second side of the outer circumferential surface of the end plate portion 141 to move the refrigerant of the motor space 112 to the oil separation space 113.

A plurality of communication grooves 136, 137 may be formed on the main frame 130 to correspond to the communication holes 146, 147, respectively, so as to communicate with the first communication hole 146 and the second communication hole 147, respectively, to move refrigerant or oil to the motor space 112 and then move the refrigerant to the oil separation space 113. As a result, a portion of refrigerant discharged to a space portion or space 191 of a discharge cover 190, which will be described hereinafter, in the compression space (P) may be moved to the motor space 112 through the first communication hole 146 and the communication groove 136 along with oil separated from the space portion 191 to cool the drive motor 120, and oil that has cooled the drive motor 120 may return to a bottom surface of the casing 110, whereas refrigerant may be moved to the oil separation space 113 through the communication groove 137 and the second communication hole 147, and discharged to an outside through the discharge pipe 116 from the oil separation space 113 along with refrigerant separated from oil.

A portion of the refrigerant discharged to the space portion 191 of the discharge cover 190, from the compression spaces (P), may be discharged to the oil separation space 113 of the casing 110, from the space portion 191, through a discharge hole 195 formed on a side surface of the discharge cover 190. Then, the discharged refrigerant may circulate in the oil separation space 113, and the refrigerant having oil removed therefrom may be discharged to the outside through the discharge pipe 116.

The orbiting scroll 150 may be coupled to the rotational shaft 160, and provided in an orbital manner between the main frame 130 and the fixed scroll 140. For the orbiting scroll 150, the end plate portion 151 of the orbiting scroll 150 supported by the main frame 130 may be formed in a disk shape, and an orbiting wrap 152 engaged with the fixed wrap 143 that forms the compression space (P) may be formed on an upper surface of the end plate portion 151 of the orbiting scroll 150, and a boss portion or boss 153 inserted and coupled to a boss portion insertion groove 162 of the rotational shaft 160 may be formed on a bottom surface of the end plate portion 151 of the orbiting scroll 150. As a result, the orbiting scroll 150 may be engaged with the fixed scroll 140 in a state of being eccentrically coupled to the rotational shaft 160 to create a pair of two compression spaces (P) having a suction chamber, an intermediate pressure chamber, and a discharge chamber while performing an orbiting movement.

The orbiting scroll 150 may be formed of an aluminum material lighter than a material of the main frame 130 along with the fixed scroll 140. As a result, a weight of the scroll compressor may be decreased and a centrifugal force generated during rotation of the orbiting scroll 150 may be decreased as well to reduce a size of a balance weight 165 coupled to the rotational shaft 160 or the rotor 122 to cancel an eccentric load. When the size of the balance weight 165 is reduced, an axial length of the rotational shaft 160 may be reduced to decrease an entire size of the scroll compressor by the reduced axial length of the rotational shaft 160 or use a free space generated in the inner space of the casing 110. In other words, an axial-directional length from the drive motor 120 to the fixed scroll 140 may be reduced by the reduced axial length of the rotational shaft 160, thereby securing a free space in the inner space of the casing 110 for other use.

For example, when the weight of the orbiting scroll 150 is decreased, an eccentric load according to a centrifugal force may be reduced as described above to operate the compressor at a high speed above about 180 Hz. However, when the scroll compressor is operated at the high speed, an amount of oil leakage may be increased to that extent, thereby reducing a reliability of the scroll compressor due to the oil shortage. Accordingly, a scroll compressor operating at a high speed may increase a volume of the oil separator to prevent oil from being excessively leaked out. However, when the oil separator is provided at an outside of the casing 110, an axial length of the compressor may be decreased, and thus, the oil separator may be increased while reducing an axial direction length of the casing 110. Secondary vibration of the oil separator may be increased, increasing the entire vibration noise of the scroll compressor.

In consideration of this, the discharge cover 190 capable of oil separation may be provided in the oil separation space 113 in a state in which the axial length of the casing 110 is maintained, thereby removing the oil separator provided at an outside of the casing 110 without increasing the axial length of the casing 110. Accordingly, it may be possible to reduce the vibration noise of the scroll compressor at a same efficiency.

On the other hand, an Oldham ring 170 that limits a rotational movement of the orbiting scroll 150 may be provided between the main frame 130 and the orbiting scroll 150. As illustrated in FIGS. 4 and 5, the Oldham ring 170 may be formed in an annular shape to be slidably coupled in a radial direction to the main frame 130 while at the same time slidably coupled in the radial direction to the orbiting scroll 150. The Oldham ring 170 may be slidably coupled in a direction perpendicular to the main frame 130 and the orbiting scroll 150. As a result, the orbiting scroll 150 may perform an orbiting movement while a rotational movement thereof is suppressed by the Oldham ring 170 provided between the main frame 130 and the orbiting scroll 150 even though a rotational force is transmitted by the rotational shaft 160.

The Oldham ring 170 may be slidably coupled between the main frame 130 and the orbiting scroll 150, thereby having a relatively low load compared to other members. Accordingly, the Oldham ring 170 may be formed of an aluminum material with low cost, high formability, and low hardness.

However, when the Oldham ring 170 is formed of aluminum, it may be made of a same type material as a material of the orbiting scroll 150 to reduce reliability of the scroll compressor while generating a lot of wear, and when the Oldham ring 170 is formed of cast iron, it may increase vibration noise of the scroll compressor. In consideration of this, the Oldham ring 170 according to an embodiment may be formed of a material or shape capable of minimizing an Increased weight of the Oldham ring 170 while using a different material from the material of the orbiting scroll 150. Moreover, as the Oldham ring 170 is slidably brought into contact with the main frame 130, it may be formed of a different material from the material of the main frame 130, but in the case of cast iron, it has a higher wear resistance than a wear resistance of aluminum, and may be formed of the same type material as the material of the main frame 130.

For example, the Oldham ring 170 may be formed of a sintered metal, more particularly, an iron-based sintered alloy. In this case, the Oldham ring 170 may be formed of a different material from the material of the orbiting scroll 150 in contrast to an aluminum material in the related art, thereby reducing wear to that extent to decrease damage of the Oldham ring 170.

However, when the Oldham ring 170 is formed of an iron-based sintered alloy, the weight of the Oldham ring may be increased compared to an aluminum Oldham ring in the related art. In consideration of this, according to an embodiment, a weight loss portion or weight reduction portion **170*a* may be formed on the Oldham ring 170 to reduce the weight of the Oldham ring. As a result, the Oldham ring 170 according to an embodiment may employ a different type of material from the material of the orbiting scroll 150 to reduce wear as well as reduce the weight of the Oldham ring through the weight loss portion 170*a*** to minimize vibration noise.

As illustrated in FIGS. 4 and 5, the Oldham ring 170 according to an embodiment may include a ring portion or ring 171 formed in an annular shape, and a plurality of key portions or keys 175 formed in a protruding manner on both axial-directional lateral surfaces of the ring portion 171. The ring portion 171 may be formed in a ring shape, and the entire both axial-directional lateral surfaces excluding the key portion 175 may be formed in a flat shape. However, a thrust surfaces 172 may be formed in a protruding manner by a predetermined height on one or a first lateral surface of the ring portion 171 formed with the key portion 175 or the other or a second lateral surface of the ring portion 171 at an opposite side to the one lateral surface, and the key portion 175 may be formed in a protruding manner on the one side thrust surface 172 between both thrust surfaces. The thrust surface 172 may be formed in an inclined manner on the ring portion, but also a stepped surface 170*b* stepped by a predetermined height from a lateral surface of the ring portion between a first key portion or key 176 and a second key portion or key 178 adjacent to each other, which will be described hereinafter, as illustrated in FIG. 4, may be formed at both sides in a circumferential direction of the thrust surface 172 to form the weight loss portion 170*a* on both axial-directional lateral surfaces of the ring portion. As a result, according to this embodiment, the weight loss portion 170*a* may be formed on both upper and lower lateral surfaces of the ring portion 171, thereby reducing a thickness of the ring portion 171.

In this case, a height of the key portion 175 may be increased by a decreased thickness of the ring portion 171, but when the height of the key portion 175 is increased, a strength of the key portion 175 may be reduced, decreasing its durability or a width of the key portion 175 increased to compensate for this, thereby increasing a friction loss. Accordingly, a thickness of the ring portion 171 may be reduced, while not increasing a height of the key portion 175 by increasing a step height of the thrust surface 172, rather than increasing the height of the key portion 175. As a result, a thickness (t21) of the ring portion may be formed to be smaller than a thickness (t22) between both thrust surfaces, namely, to be smaller than a thickness (t1) of the ring portion in the related art by a thickness of the weight loss portion 170*a*. Further, though not shown in the drawing, the ring portion 171 may be formed in a hollow shape or formed in a cross-sectional shape, an inner circumferential surface or an outer circumferential surface of which may be depressed by a predetermined depth.

The key portion 175 may include a first key portion or key 176 slidably inserted into a key groove 135 of the main frame 130 and a second key portion or key 178 slidably inserted into a key groove 155 of the orbiting scroll 150. The first key portion 176 may be formed on one axial-directional lateral surface of the ring portion 171 spaced at intervals of approximately 180 degrees along a circumferential direction, and the second key portion 178 may be formed on the other axial-direction lateral surface of the ring portion 171 spaced at intervals of approximately 180 degrees along the circumferential direction. The first key portion 176 and second key portion 178 may be alternately formed at intervals of approximately 90 degrees along the circumferential direction when projected onto a plane.

Figure 6:
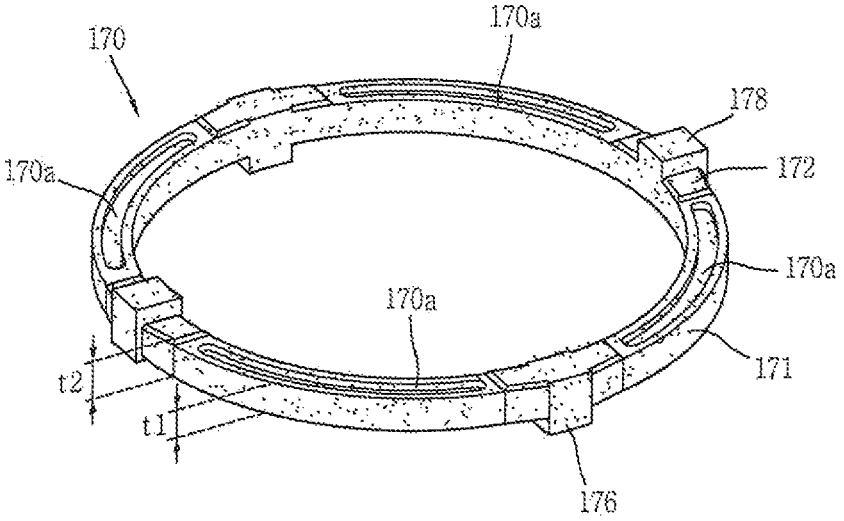
FIG. 6 is a perspective view illustrating another embodiment of an Oldham ring according to FIG. 3.

As illustrated in FIG. 6, the weight loss portion 170*a* may be formed with a hole or groove having a predetermined cross-sectional area on the ring portion 171. Accordingly, the weight loss portion 170*a* of this embodiment may be formed by an entire volume of a hole or groove. In this case, the thickness (t1) of the ring portion 171 may be formed to be the same as the thickness (t2) between both thrust surfaces as in the related art to maintain a rigidity of the Oldham ring. However, the thickness of the ring portion 171 may be formed to be smaller than the thickness of the ring portion in the related art to form a weight loss portion.

Another embodiment of the Oldham ring will be described hereinafter.

According to previous embodiment, the entire Oldham ring may be formed of an iron-based sintered alloy, such as aluminum, and an increased weight of the Oldham ring may be reduced by the weight loss portion. However, according to this embodiment, there is provided a method of forming the ring portion and the key portion with different materials for their assembly.

Figure 7:
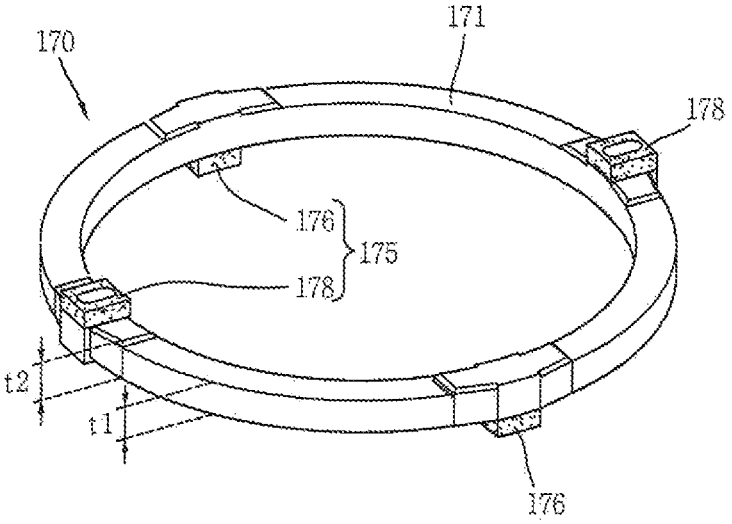
FIG. 7 is a perspective view illustrating still another embodiment of an Oldham ring according to FIG. 3.

As illustrated in FIG. 7, while the ring portion 171 is formed of a hard aluminum material as in the related art, only the key portion 175 substantially receiving a load with respect to the main frame 130 and the orbiting scroll 150 may be formed of a different material, for example, cast iron, that is, the same material as the material of the main frame, or an iron-based sintered alloy different from that of the main frame. In this case, the thickness (t1) of the key portion 175 may be formed to have the same thickness as that of the ring portion of the Oldham ring with an aluminum material in the related art. As a result, it may be possible to reduce an increased weight of the entire Oldham ring, as well as suppress the key portion 175 of the Oldham ring 170 from being worn out.

Figure 8:
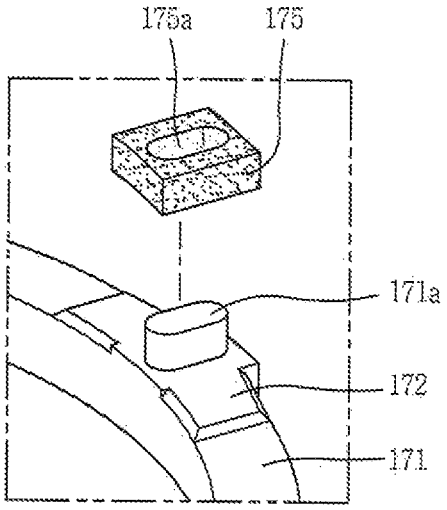
FIGS. 8 and 9 are perspective views illustrating each embodiment in which a key portion is coupled to a ring portion in an Oldham ring according to FIG. 7.
Figure 9:
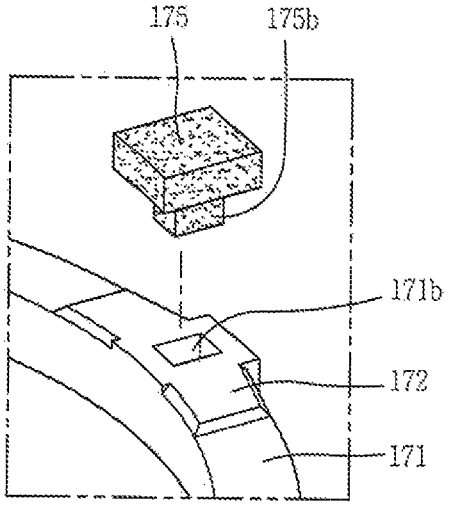

The ring portion and key portion may be coupled to each other in the methods illustrated in FIGS. 8 and 9. The embodiment according to FIG. 8 is a method of forming a fixed protrusion on the ring portion to be coupled to the key portion, and the embodiment according to FIG. 9 is a method of forming a fixed protrusion on the key portion to be coupled to the ring portion contrary to FIG. 8.

As illustrated in FIG. 8, between both axial-directional lateral surfaces of the ring portion 171, a fixed protrusion 171*a* having a predetermined height may be formed at a portion to be coupled to the key portion 175, and a fixed hole (may be a fixed groove) 175*a* to fix the fixed protrusion 171*a* to be inserted and not moved may be formed on the key portion 175. The fixed protrusion 171*a* may be pressed to the fixed hole 175*a* or inserted and then adhered by welding or an adhesive, for example. In this case, the fixed protrusion 171*a* or the fixed hole 175*a* may be formed with a rectangular or angular shape so as not to spin the key portion 175 with no traction.

As illustrated in FIG. 9, a fixed groove 171*b* and a fixed protrusion 175*b* may be formed on the ring portion 171 and the key portion 175, respectively, to be pressed or coupled to each other by adhesion as illustrated in the previous embodiment. Even in this case, the fixed protrusion 175*b* and the fixed groove 171*b* may be formed with a rectangular or angular shape.

When only a key of the Oldham ring is formed of a sintered metal as described above, it may be possible to minimize an increased weight of the Oldham ring compared to a case in which the entire Oldham ring is formed of a heavy iron-based sintered alloy other than aluminum. Accordingly, it is formed of a different type of material from those of the main frame 130 and the orbiting scroll 150, thereby suppressing wear of the Oldham ring to that extent or reducing a weight of the Oldham ring to decrease vibration noise of the scroll compressor. Even in this case, the thickness (t1) of the ring portion 171 may be formed to be the same as the thickness of the ring portion in the related art, but formed to be smaller than the thickness of the ring portion in the related art, thereby forming a weight loss portion on the ring portion.

Figure 2:
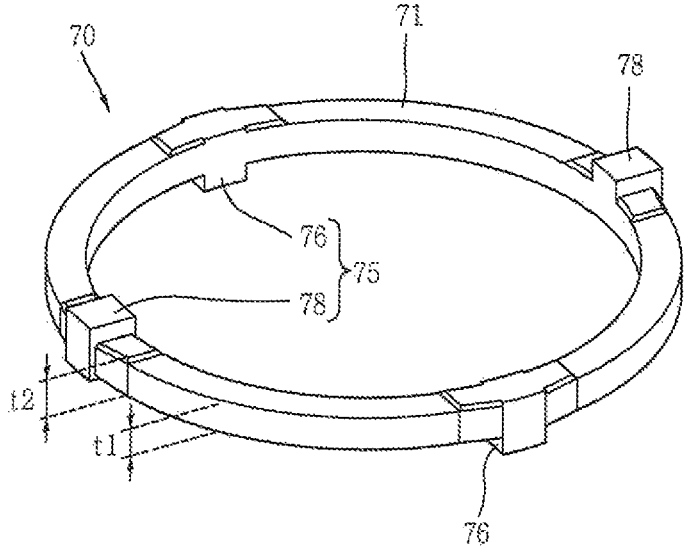
FIG. 2 RELATED ART
FIG. 2 is a perspective view illustrating an Oldham ring in the related art according to FIG. 1.
Figure 10:
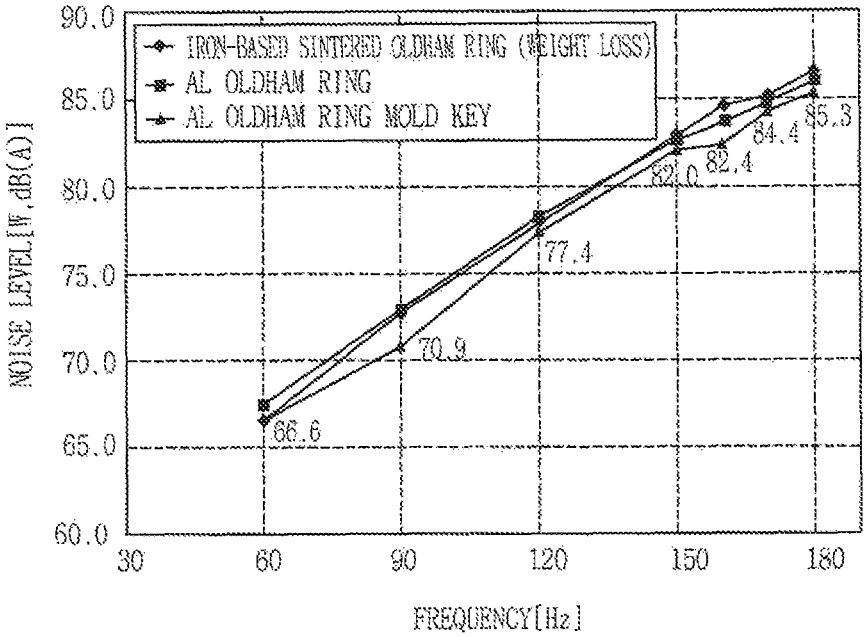
FIGS. 10 and 11 are graphs illustrating noise level and pipe vibration in which Oldham rings according to embodiments are compared with aluminum Oldham rings in the related art.
Figure 11:
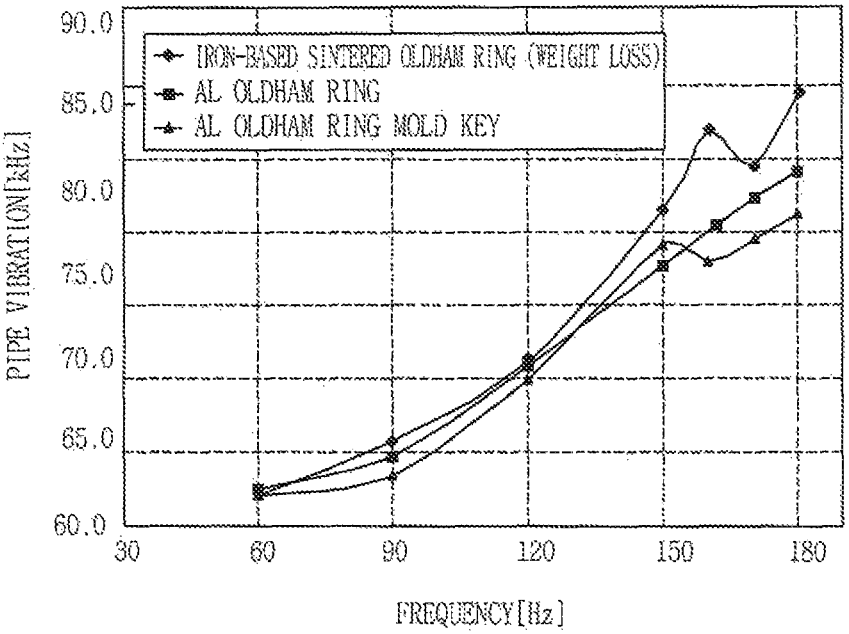

FIGS. 10 and 11 are graphs illustrating noise level and pipe vibration in which Oldham rings according to embodiments are compared with aluminum Oldham rings in the related art. As illustrated in FIG. 10, an Oldham ring (Oldham ring in FIG. 6) with a weight loss portion and formed of an iron-based sintered alloy may have substantially similar characteristics to those of an aluminum Oldham ring (Oldham ring in FIG. 2), but it is seen that an Oldham ring (Oldham ring in FIG. 7) in which the key portion is formed of a mold on the aluminum ring portion has enhancement in noise level compared to the aluminum Oldham ring in the related art. It may be derived that wear of the Oldham ring generated during operation of the scroll compressor for a long period of time is reduced to stably maintain an operation state of the scroll compressor.

As illustrated in FIG. 11, it is seen that the Oldham ring in FIG. 7 is enhanced compared to the aluminum Oldham ring in the related art, particularly, above 150 Hz even with respect to pipe vibration. It is also derived that wear of the Oldham ring is minimized to enhance the entire vibration while an operation state of the compressor is stably maintained.

Further, it is seen that noise and vibration of the Oldham ring are not greatly increased compared to other Oldham rings. It may be derived that as the ring portion of the Oldham ring is formed with a thickness of about 5 mm which is smaller than 6 mm, a thickness of the ring portion of the aluminum Oldham ring in the related art, by 1 mm, a weight of the Oldham ring is smaller by about 20% compared to the Oldham ring in the related art to reduce vibration noise to at extent.

Still another embodiment of the Oldham ring will be described hereinafter.

Figure 12:
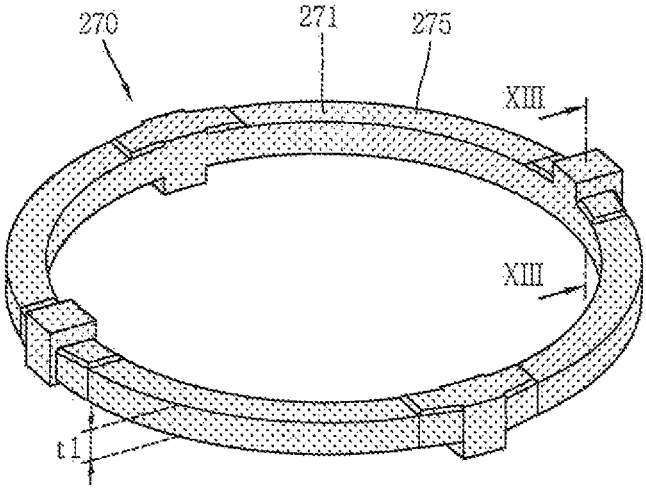
FIG. 12 is a perspective view illustrating yet still another embodiment of an Oldham ring according to FIG. 3.

According to the previous embodiments, the entire or part of the Oldham ring may be changed to an iron-based sintered alloy or cast iron, but according to this embodiment, a base metal portion or base metal 271 forming an Oldham ring 270 may be formed of a light material, such as aluminium, but an outer surface of the base metal portion 271 may be formed with a wear-resistant coating layer 275, as illustrated in FIG. 12. In this case the thickness (t1) of the ring portion may be formed to be the same as the thickness of the ring portion of the Oldham ring in the related art made of an aluminum material. However, the thickness (t1) of the ring portion 171 may be also formed to be smaller than the thickness of the ring portion in the related art to form a weight loss portion on the ring portion.

The wear-resistant coating layer 275 may be selected in consideration of elastic coefficient, frictional coefficient, heat resistance, chemical resistance, and thermal expansion coefficient, for example, and the selected coating material may be directly coated and formed on a surface of the base metal portion 271. However, in this case, due to characteristics of an aluminum material, a coating layer may be peeled off due to a low adhesivity or different thermal expansion coefficient. Accordingly, the wear-resistant coating layer 275 may be formed with at least two or more layers, and the plurality of layers may be formed of materials in such a manner that a layer closer to a surface of the base metal portion has a low hardness and a layer away from the base metal portion has a high hardness.

Figure 13:
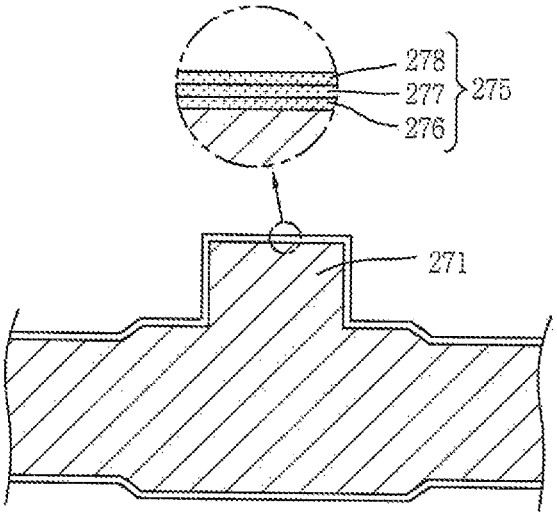
FIG. 13 is a cross-sectional view taken along line "XIII-XIII" in FIG. 12.

For example, as illustrated in FIG. 13, the wear-resistant coating layer 275 according to this embodiment may be formed with a Nickel-Phosphorus (Ni—P) layer 276→a buffer layer 277→a Silicon-diamond-like-Carbon (Si-DLC) layer 278 on a surface of the base metal portion 271. For a buffer layer, chromium, tungsten, or bromide, for example, may be applicable thereto, and the elastic coefficient, frictional coefficient, heat resistance, chemical resistance, and thermal expansion coefficient thereof, for example, may be in a medium range in comparison to the Ni—P layer or Si-DLC layer.

Figure 14:
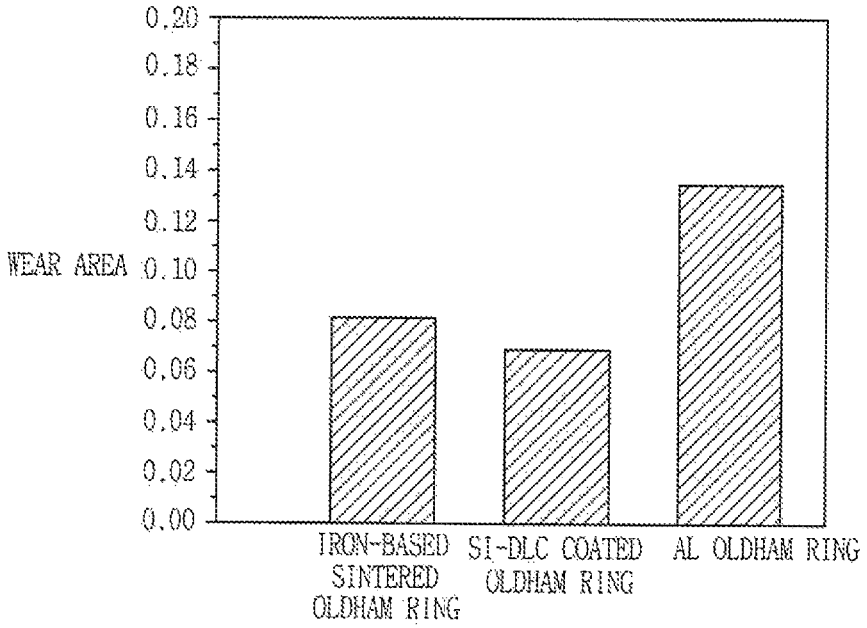
FIGS. 14 and 15 are graphs illustrating wear area and wear losses in which Oldham rings coated with a wear-resistant layer (Si-DLC) according to embodiments are compared with iron-based sintered alloy and aluminum Oldham rings.
Figure 15:
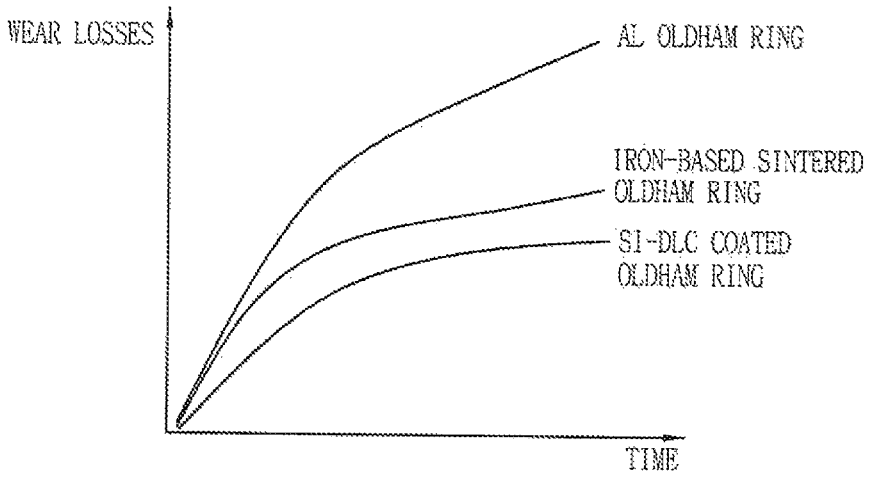

FIGS. 14 and 15 are graphs illustrating wear area and wear losses in which Oldham rings coated with a wear-resistant layer (Si-DLC) according to this embodiment are compared with iron-based sintered alloy and aluminum Oldham rings. As illustrated in the drawings, it is seen that a coated Oldham ring according to this embodiment has a reduced wear area and an enhanced wear loss compared to an Oldham ring made of an iron-based sintered alloy.

Accordingly, aluminum may be applied to the base metal portion 271 not to increase the weight of the Oldham ring 270, and the wear-resistant coating layer 275 may be formed on a surface of the base metal portion 271, thereby effectively suppressing or preventing the Oldham ring 270 from being worn out. Through this, it may be possible to operate the scroll compressor above approximately 180 Hz, as well as maintain reliability of the Oldham ring, thereby reducing vibration noise of the pipe as well as the scroll compressor.

Embodiments disclosed herein provide a compressor capable of suppressing or preventing wear of an Oldham ring or a member brought into contact with the Oldham ring. Embodiments disclosed herein further provide a compressor in which an orbiting scroll and an Oldham ring may be formed of different types of materials. Embodiments disclosed herein further provide a compressor capable of forming the materials of the orbiting scroll and the Oldham ring with different types of materials as well as suppressing or preventing eccentric load from being excessively increased.

Embodiments disclosed herein provide a scroll compressor in which the Oldham ring may be formed of a material having a higher hardness than that of the orbiting scroll. The orbiting scroll may be formed of an aluminum material, and the entire Oldham ring may be formed of a sintered metal. Alternatively, the Oldham ring may include a ring portion or ring and a key portion or key, and the ring portion and key portion may be formed of different materials. The key portion may be formed of a material having a higher hardness than that of the ring portion.

Embodiments disclosed herein provide a scroll compressor that may include a casing having a sealed inner space; a drive motor provided in the inner space of the casing to generate a rotational force; a rotational shaft coupled to a rotor of the drive motor to rotate; an orbiting scroll formed of an aluminum material, and coupled to the rotational shaft to perform an orbiting movement; a fixed scroll coupled to the orbiting scroll to form a compression space including a suction chamber, an intermediate pressure chamber, and a discharge chamber; and a rotation preventing member or Oldham ring coupled to the orbiting scroll, and formed of a sintered metal.

The rotation prevention member may include a ring portion or ring; and a plurality of key portions or keys formed in a protruding manner on both axial-directional lateral surfaces of the ring portion to allow the rotation prevention member to be slidably coupled in a radial direction to key grooves of the corresponding member. The ring portion may be formed with a stepped surface on axial-directional lateral surfaces thereof.

Further, the rotation prevention member may include a ring portion or ring; and a plurality of key portions or keys formed in a protruding manner on both axial-directional lateral surfaces of the ring portion to allow the rotation prevention member to be slidably coupled in a radial direction to key grooves of the corresponding member. The ring portion may be formed with a hole or groove having a predetermined volume.

Embodiments disclosed herein further provide a scroll compressor that may include a casing having a sealed inner space; a drive motor provided in the inner space of the casing to generate a rotational force; a rotational shaft coupled to a rotor of drive motor to rotate; an orbiting scroll coupled to the rotational shaft to perform an orbiting movement; a fixed scroll coupled to the orbiting scroll to form a compression space including a suction chamber, an intermediate pressure chamber, and a discharge chamber; and a rotation prevention member or Oldham ring coupled to the orbiting scroll, at least a part or portion of which is formed of a different material from that of the orbiting scroll. The rotation prevention member may be formed of a material having a higher hardness than that of the orbiting scroll.

Further, the rotation prevention member may include a ring portion or ring; and a plurality of key portions or keys formed in a protruding manner on both axial-directional lateral surfaces of the ring portion to allow the rotation prevention member to be slidably coupled in a radial direction to key grooves of the corresponding member. The ring portion is formed with a stepped surface on the axial-directional lateral surfaces thereof.

Furthermore, the rotation prevention member may include a ring portion or ring; and a plurality of key portions or keys formed in a protruding manner on both axial-directional lateral surfaces of the ring portion to allow the rotation prevention member to be slidably coupled in a radial direction to key grooves of the corresponding member. The ring portion may be formed with a hole or groove having a predetermined volume.

The rotation prevention member may be formed of a plurality of members having different materials. Also, the orbiting scroll may be formed of an aluminum material, and a portion of the rotation prevention member coupled to the orbiting scroll may be formed of a material other than aluminum. A portion of the rotation prevention member coupled to the orbiting scroll may be formed of a material having a higher hardness than that of the orbiting scroll.

Further, the rotation prevention member may include a ring portion or ring; and a plurality of key portions or keys formed in a protruding manner on both axial-directional lateral surfaces of the ring portion to allow the rotation prevention member to be slidably coupled in a radial direction to key grooves of the corresponding member. The ring portion and key portion may be formed of different materials. Either one of the ring portion and key portion may be formed with a protrusion, and the other one thereof may be formed with a groove or hole into which the protrusion may be inserted.

The casing may be provided with a frame fixed to the casing and slidably coupled to the rotation prevention member, and the rotation prevention member may be formed with a key portion or key inserted into a member corresponding to the rotation prevention member and slidably coupled thereto in a radial direction. The key portion may be formed of the same material as that of the frame.

Embodiments disclosed herein provide a scroll compressor that may include a casing having a sealed inner space; a drive motor provided in the inner space of the casing to generate a rotational force; a rotational shaft coupled to a rotor of drive motor to rotate; an orbiting scroll coupled to the rotational shaft to perform an orbiting movement; a fixed scroll coupled to the orbiting scroll to form a compression space including a suction chamber, an Intermediate pressure chamber, and a discharge chamber; and a rotation prevention member or Oldham ring coupled to the orbiting scroll to have a coating portion or coating having a different material from that of the orbiting scroll on an outer surface of a base metal portion or base metal formed of a same material as that of the orbiting scroll. The coating portion may be formed with a plurality of layers having different materials.

For a plurality of layers constituting the coating portion, a layer located further away from the base metal portion may be formed of a material with a higher hardness. As a result, in a scroll compressor according to embodiments disclosed herein, the entire or a part or portion of the Oldham ring may be formed of a different material from that of the orbiting scroll, thereby suppressing or preventing the Oldham ring from being worn out. Further, in this case, a weight loss portion or weight loss may be formed on part of the Oldham ring, thereby suppressing or preventing a vibration noise of the scroll compressor from being increased due to a weight increase of the Oldham ring. In addition, the Oldham ring may be formed with the same material as that of the orbiting scroll, while a wear-resistant coating layer may be formed on a surface thereof, thereby suppressing or preventing a weight of the Oldham ring from increasing as well as suppressing or preventing the Oldham ring from been worn due to contact with the orbiting scroll.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having a sealed inner space;

a drive motor provided in the inner space of the casing to generate a rotational force;

a rotational shaft rotatably coupled to the drive motor;

an orbiting scroll formed of an aluminum material, and coupled to the rotational shaft to perform an orbiting movement;

a fixed scroll coupled to the orbiting scroll to form a compression space; and an Oldham ring coupled to the orbiting scroll, and formed of a sintered metal, wherein the Oldham ring includes:

a ring; and a plurality of keys formed of a same material and as a single body with the ring, the plurality of keys formed in a protruding manner on at least one of axial-direction lateral surfaces of the ring to allow the Oldham ring to be slidably coupled in a radial direction to key grooves of the orbiting scroll, wherein the ring includes:

a plurality of thrust surfaces formed on an opposite surface to a surface having the plurality of keys, and the plurality of thrust surfaces continuously formed at both side surfaces of the plurality of keys in a circumferential direction and protruding by a predetermined height, wherein the plurality of thrust surfaces is supported by a member corresponding to the Oldham ring;

a plurality of stepped surfaces that extends in a stepped manner from both side surfaces of the respective plurality of thrust surfaces in the circumferential direction; and a weight reducing portion that extends between the plurality of stepped surfaces as to connect the plurality of stepped surfaces to each other, wherein a circumferential length of the weight reducing portion is longer than a circumferential length of the plurality of thrust surfaces, and an axial height of the weight reducing portions is lower than an axial length of the plurality of thrust surfaces.

2. The scroll compressor of claim 1, wherein the casing is provided with a frame fixed to the casing and slidably coupled to the Oldham ring, and the Oldham ring is formed with the plurality of keys inserted into key grooves of the frame to be slidably coupled thereto in the radial direction.

3. The scroll compressor of claim 1, wherein the ring includes a plurality of holes or grooves having a predetermined cross sectional area.

4. The scroll compressor of claim 3, wherein the plurality of holes or grooves is provided in the weight reducing portion of the ring.

5. A scroll compressor, comprising:

a casing having a sealed inner space;

a drive motor provided in the inner space of the casing to generate a rotational force;

a rotational shaft rotatably coupled to the drive motor;

an orbiting scroll coupled to the rotational shaft to perform an orbiting movement;

a fixed scroll coupled to the orbiting scroll to form a compression space; and an Oldham ring coupled to the orbiting scroll, at least a portion of which is formed of a different material from a material of the orbiting scroll, wherein the Oldham ring includes:

a ring; and a plurality of keys formed in a protruding manner on at least one of axial-direction lateral surfaces of the ring to allow the Oldham ring to be slidably coupled in a radial direction to key grooves of the orbiting scroll, wherein the ring and the plurality of keys are formed of different materials, wherein either one of the ring or the plurality of keys is formed with a protrusion, and the other one thereof is formed with a groove or hole into which the protrusion is inserted, wherein the groove or hole is formed in a shape that fully surrounds the protrusion to support the protrusion in the radial direction, and wherein the protrusion is formed as a single body on the ring or the key.

6. The scroll compressor of claim 5, wherein the Oldham ring is formed of a material having a higher hardness than a hardness of the orbiting scroll.

7. The scroll compressor of claim 6, wherein the ring is formed with a stepped surface on at least one of the axial-direction lateral surfaces.

8. The scroll compressor of claim 6, wherein the ring is formed with the hole or groove having a predetermined volume.

9. The scroll compressor of claim 5, wherein the orbiting scroll is formed of an aluminum material, wherein the ring is formed of an aluminium material, and wherein the plurality of keys is formed of a material having a higher hardness than a hardness of the orbiting scroll.

10. The scroll compressor of claim 5, wherein the casing is provided with a frame fixed to the casing and slidably coupled to the Oldham ring, wherein the Oldham ring is formed with the plurality of keys inserted into key grooves of the frame to be slidably coupled thereto in a radial direction, and wherein the plurality of keys is formed of the same material as a material of the frame.

11. The scroll compressor of claim 5, wherein the protrusion is pressed to the groove or hole.

12. The scroll compressor of claim 5, wherein the protrusion is configured to be inserted into the groove or hole and then welded to the groove or hole.

13. The scroll compressor of claim 5, wherein the protrusion is configured to be inserted into the groove or hole and then adhered to the groove or hole by an adhesive.

14. The scroll compressor of claim 5, wherein the protrusion or the groove or hole has a cross-section in a rectangular or an angular shape.

* * * * *